US007938347B2

(12) United States Patent
Romanovich

(10) Patent No.: US 7,938,347 B2
(45) Date of Patent: May 10, 2011

(54) SHREDDER HAVING A DUAL STAGE CUTTING MECHANISM

(75) Inventor: Dmitry Romanovich, Glen Ellyn, IL (US)

(73) Assignee: Fellowes, Inc., Itasca, IL (US)

( * ) Notice: Subject to any disclaimer, the term of this patent is extended or adjusted under 35 U.S.C. 154(b) by 179 days.

(21) Appl. No.: 12/349,605

(22) Filed: Jan. 7, 2009

(65) Prior Publication Data

US 2010/0170970 A1 Jul. 8, 2010

(51) Int. Cl.
*B02C 25/00* (2006.01)
*B02C 4/00* (2006.01)

(52) U.S. Cl. ..... 241/30; 241/101.4; 241/152.2; 241/236

(58) Field of Classification Search ..... 241/101.4, 241/159, 152.2, 221, 236; 83/35, 301, 408, 83/498

See application file for complete search history.

(56) References Cited

U.S. PATENT DOCUMENTS

| | | | | |
|---|---|---|---|---|
| 2,836,018 | A * | 5/1958 | Key | 451/58 |
| 3,713,358 | A * | 1/1973 | Honeycutt et al. | 83/35 |
| 4,068,805 | A | 1/1978 | Oswald | |
| 4,192,467 | A | 3/1980 | Hatanaka | |
| 4,522,096 | A | 6/1985 | Niven, Jr. | |
| 5,016,828 | A | 5/1991 | Utsumi et al. | |
| 5,071,080 | A | 12/1991 | Herbst et al. | |
| 5,358,187 | A * | 10/1994 | Ward | 241/3 |
| 7,025,293 | B2 | 4/2006 | Matlin et al. | |

* cited by examiner

*Primary Examiner* — Faye Francis
(74) *Attorney, Agent, or Firm* — Pillsbury Winthrop Shaw Pittman LLP

(57) ABSTRACT

A shredder is disclosed having a dual stage cutting mechanism. The dual stage cutting mechanism generally includes two pairs of cutters for performing two distinct cutting operations. The pair of first cutters is configured to pierce rows of staggered cross-cuts into material to create a waffle-like pattern. Disposed below the pair of first cutters, the pair of second cutters is configured to strip cut the pierced material.

19 Claims, 4 Drawing Sheets

SHREDDER HAVING A DUAL STAGE CUTTING MECHANISM

FIELD

This application generally relates to shredders for destroying articles, such as paper documents, compact disks, etc.

BACKGROUND

Shredders are well known devices for destroying articles, such as documents, CDs, floppy disks, etc. Typically, users purchase shredders to destroy sensitive articles, such as credit card statements with account information, documents containing company trade secrets, etc.

A common type of shredder has a shredder mechanism contained within a housing that is removably mounted atop a container. The shredder mechanism typically has a pair of cutter elements and a cutting block fixed relative to the shredder mechanism that shred articles fed therein and discharges the shredded articles downwardly into the container.

This design may result in "birdnesting," though, in which long debris particles from the shredder entangle and can get caught into the cutter elements.

SUMMARY

According to one embodiment of this disclosure, a shredder is provided comprising: a pair of cooperating first cutters configured to pierce rows of staggered cross-cuts into a material to be shredded, each of the pair of first cutters comprising: a plurality of first cutting discs equally spaced on a first shaft, wherein each of the first cutting discs includes a main body with a plurality of projecting teeth, and wherein the main bodies of the first pair of cutters are not interleaved with one another; and a pair of cooperating second cutters, disposed down-stream of first cutters in the material feed direction, that are configured to form a plurality of strip cuts in the pierced material, each of the pair of second cutters comprising: a plurality of second cutting discs equally spaced on a second shaft, wherein the first cutting disc and the second cutting discs are positioned adjacent to each other such that the staggered cross-cuts formed by the first cutters are substantially aligned with the strip cuts formed by the second cutters.

According to another embodiment of this disclosure, a method of shredding material is provided comprising: feeding material to be shredded; piercing rows of staggered cross-cuts into the material; and subsequently forming a plurality of strip cuts in the pierced material, wherein that the staggered cross-cuts are aligned with the strip cuts, so as to form a plurality of debris particles.

Other features of one or more embodiments of this disclosure will seem apparent from the following detailed description, and accompanying drawings, and the appended claims.

BRIEF DESCRIPTION OF THE DRAWINGS

Embodiments of the present disclosure will now be disclosed, by way of example only, with reference to the accompanying schematic drawings in which corresponding reference symbols indicate corresponding parts, in which.

DETAILED DESCRIPTION

A dual stage cutting mechanism for a shredder is provided. According to an aspect of the invention, the dual stage cutting mechanism provides separate cross-cutting and strip cutting operations. Each operation may be handled by a specialized pair of cooperating cutter elements. Material being shredded (e.g., sheets of paper) may be introduced into the pair of first cutters which may be used to pierce rows of staggered cross-cuts in the material. Next, the pair of second cutters may be used to strip cut the pierced material.

Figure 1:
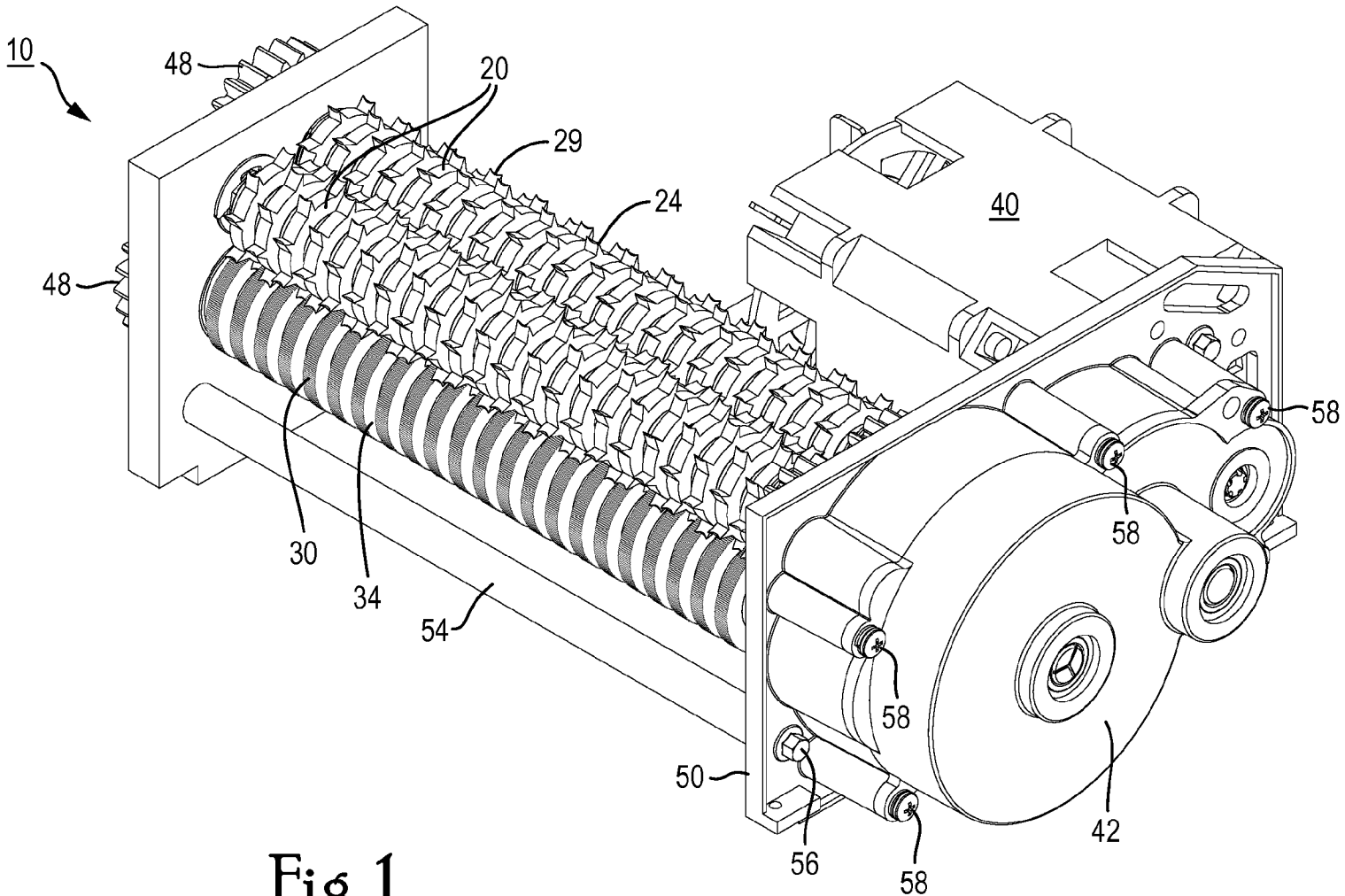
FIG. 1 shows the dual stage cutting mechanism, according to one embodiment of the disclosure.
Figure 2:
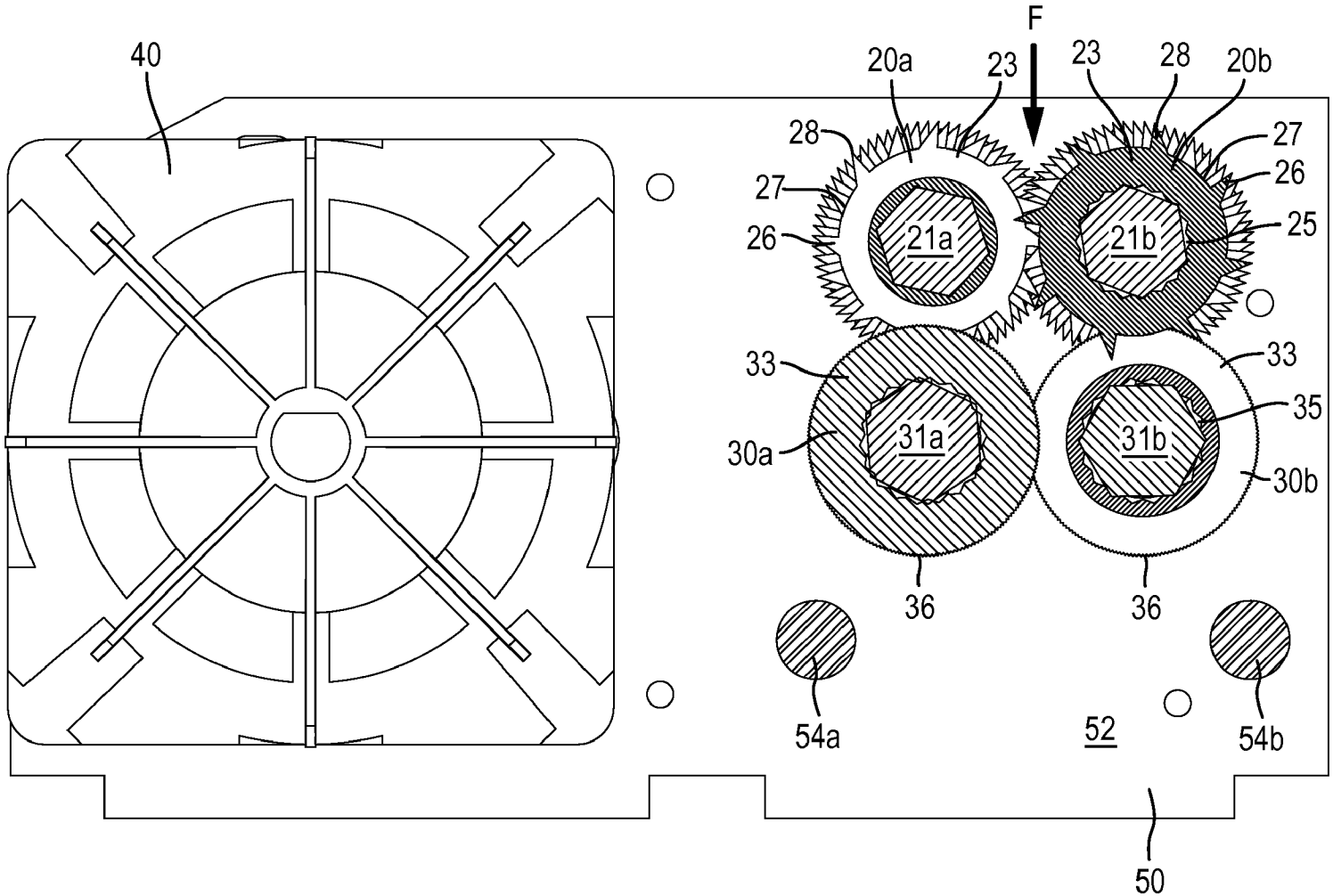
FIG. 2 shows a cross-sectional view of the dual stage cutting mechanism shown in FIG. 1.
Figure 3:
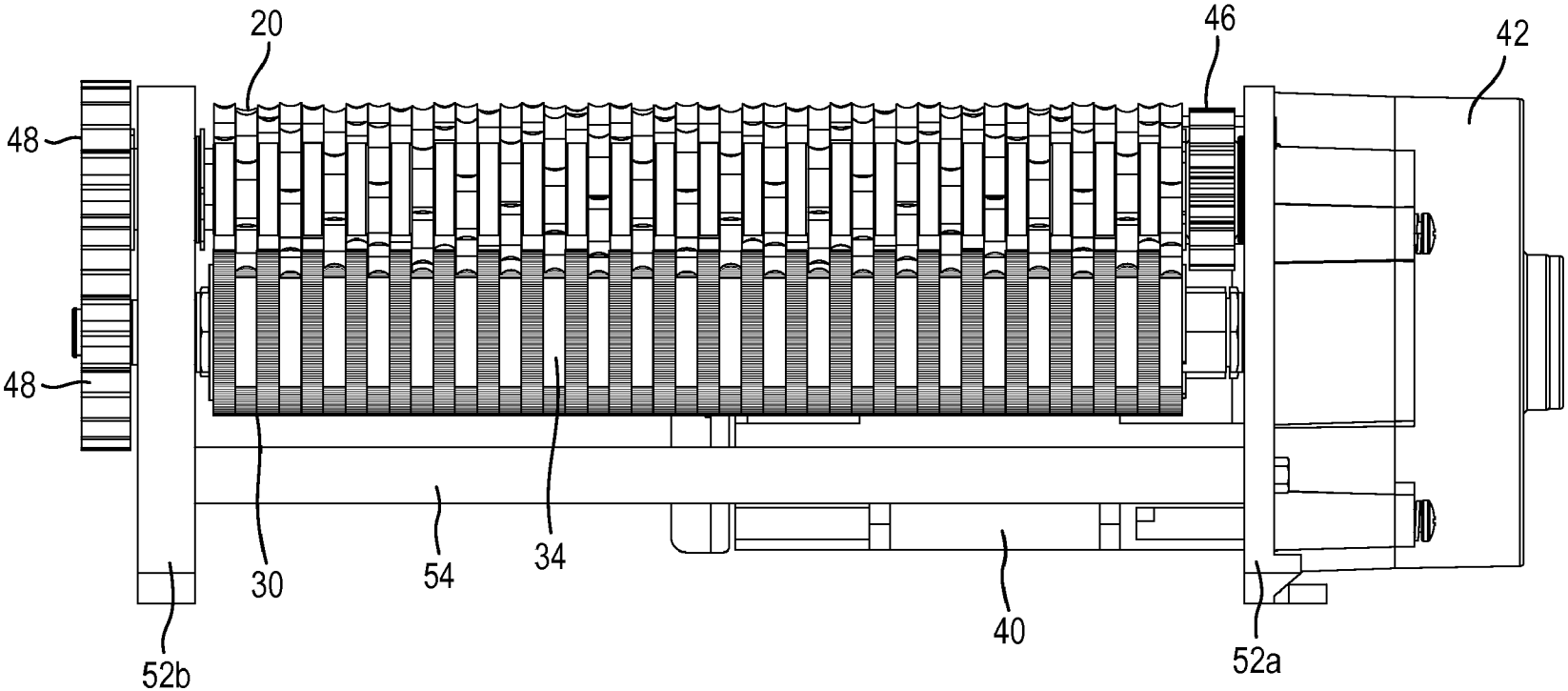
FIG. 3 shows a front view of the dual stage cutting mechanism shown in FIG. 1.

FIGS. 1-3 show the dual stage cutting mechanism 10, according to one embodiment of the disclosure.

The dual stage cutting mechanism 10 generally includes a pair of first cutters 20, a pair of second cutters 30, a drive mechanism 40 for rotating the cutters 20, 30, and a frame 50 for supporting the cutters 20, 30 and drive mechanism 40.

The dual stage cutting mechanism 10, when assembled, may form a subassembly, which may be incorporated into a compact shredder assembly, for example, as shown in U.S. Pat. No. 7,025,293. In other implementations, the dual stage cutting mechanism 10 may also be incorporated into another assembly, or may even be a stand-alone device.

The pair of first cutters 20 (20*a*, 20*b*) are provided in a generally spaced apart arrangement. Each of the first cutters 20*a*, 20*b* may include a first shaft 21 (21*a*, 21*b*) having a plurality of first cutting discs 23 spaced equally apart on the shaft 21 and forming a plurality of spaces 24 between adjacent first cutting discs 23. The spaces 24 may be sized to be slightly larger than the width of the first cutting discs 23.

Each of the first cutting discs 23 may have a body having a circular cross-section with a central opening 25 for engaging one of the first shafts 21. In one embodiment, the central openings 25 of the first cutting discs 23 may be sized so as to form an interference or press (frictional) fit with one of the first shaft 21 when assembled. In addition, the first shafts 21 and the first cutting discs 23 may include non-circular engaging features for preventing relative rotation thereof. For example, as shown in FIG. 2, the first shaft 21 may have a generally hexagonal cross-section for engaging the central opening 25 of the first cutting discs 23. Other configurations and/or "keyed" connections are also possible.

The first cutting discs 23 each include a plurality of projecting teeth 26 which extend generally outwardly at an slight angle from the periphery 27 of the first cutting disc 23 to a cutting edge 28, in a direction perpendicular to an axis of the first shaft 21 (i.e., a radial direction). The projecting teeth 26 may taper to a single cutting edge 28.

In some implementations, the cutting edges 28 may also include an inwardly "U" shaped curved recess 29. The curved piercing teeth improve piercing efficiency. This may also be accomplished by tapering the tip similar to teeth in a typical cross cut shredder, or by forming a "V" shape instead of a "U" shape tip profile. Improving piercing efficiency also contributes to a smoother sounding cutting operation (i.e., a less violent piercing operation).

The first cutting discs 23 are staggered on their respective first shafts 21, such that the projecting teeth 26 of one of the pair of first cutters extend within spaces 24 between adjacent teeth 26 of the other of the pair of the first cutters 20.

In operation, the pair of first cutters 20 pierce the material to be shredder to create a "waffle" like pattern having rows of staggered cross-cuts into the material as it passes. The cross-cuts may be oriented perpendicular to the fed direction. Although, it will be appreciated that the projecting teeth 26 of the first cutters 20 may also be oriented to provide angled and other shaped and sized cross-cuts (or slots). However, the main bodies of the first cutting disc 23 (i.e., the circular part in the Figures from which the teeth 36 project) do not interleave and thus, do not cut the paper. This is a significant departure from prior cross-cutting discs construction, which use the interleaving main bodies to cut in the longitudinal feed direction and teeth to cut in the lateral direction, thus forming paper chips.

From there, the pieced material having passed through the first cutters 20 of the dual stage cutting mechanism 10 continues to the pair of second cutters 30. The pair of second cutters 30 (30*a*, 30*b*) may be disposed downstream (in the material feed direction) of the pair of first cutters 20. In one implementation, the pair of second cutters 30 may be located below the pair of first cutters 20. Although, other orientations may also be possible.

The second cutters 30 are provided in a generally spaced apart arrangement (similar to the pair of first cutters 20). Each of the pair of second cutters 30 includes a shaft 31 (31*a*, 31*b*) having a plurality of second cutting discs 33 disposed equally spaced apart on the second shaft 31 with spaces 34 between adjacent second cutting discs 33. The spaces 34 may be sized so as to be slightly larger than the width of the second cutting discs 33.

The second cutting discs 33 may have a main body with a generally circular cross-section having a central opening 35 for engaging one of the second shafts 31. For example, the central opening 35 may be sized so as to form an interference or press (frictional) fit with one of the second shafts 31 In addition, the second shafts 31 and the second cutting discs 35 may include non-circular engaging features for preventing relative rotation thereof (similar to the first cutters 20). For example, as shown in FIG. 2, the second shafts 31 may have a generally hexagonal cross-section for engaging the central opening 35 of the first cutting discs. Other configurations and/or "keyed" connections are also possible.

The second cutting discs 33 are configured differently from the first cutting discs. For example, the second cutting discs 33 are generally circular. In some implementation, the second cutting discs 33 may include a plurality of small serrated edges 36 extending from the periphery of the blade. The serrated edges are adapted for strip cutting material.

The second cutting discs 33 may be staggered on their respective second shafts 31, such that the second cutting discs 33 of one of the pair of second cutters extend within spaces 34 between adjacent second cutting discs 33 of the other of the pair of the second cutters 30. The material being shredded may be meshed between the cooperating second cutters 30. As such, the serrated teeth 36 of adjacent second cutting discs 33 create a plurality of strip cuts parallel to the fed direction of the material. The width of the second cutting discs 33 and spaces 34 therebetween may be sized to be the same or approximately the same as the first cutting discs 23 and spaced 24 therebetween. Thus, the strip cuts help to separate the material between adjacent pierced cross-cuts.

The first cutting discs 23 and the second cutting discs 33 may be disposed adjacent to each other such that the projecting teeth 26 of the first cutters 20 extend within spaces 34 between adjacent second cutting discs 33 (and vice-versa) in a cooperating manner. For example, the width of the second cutting discs 33 may be sized appropriately for that of the first spaces 24, and width of the first cutting discs 23 may be sized appropriately for that of the second spaces 34.

By meshing or interleaving the first cutting discs 23 and the second cutting discs 33, the strip cutting will be substantially aligned with the pierced cross-cuts. Because opposed cutting discs have the same or approximately the same cutting width, this ensures matching between the pierce cutting and the strip cutting.

In operation, the pair of second cutters 30 form a plurality of strip-cuts in the pierced material. Preferably, the first cutting discs and the second cutting discs may be positioned such that the staggered cross-cuts are aligned with the strip cuts. As such, debris particles may be separated from the material. The debris particles may drop into a bin or other receptacle for collection and later disposal or recycling.

The drive mechanism 40 may be connected to one or both of the first cutters 20 or the second cutters 30 to provide a driving force thereto, via one or more gears located within a gear box 42, for driving the cutters. In one implementation, the drive mechanism 40 may include an electric motor.

In addition, a first pair of gears 46 may be attached to one of the ends of the first shafts 21 so that each of the first cutters 20 may be cooperatively rotated together. Alternatively of additionally, the first pair of gears 46 could be attached to the ends of the second shaft 31 so that each of the second cutters 30 may be cooperatively rotated together.

Similarly, a second pair of gears 48, for example, located on the first and second shafts opposite the drive mechanism 40, may rotationally connect the first cutters 20 with the second cutters 30. Thus, the first cutters 20 and second cutters 30 may be driven together. The gears 48 may the substantially the same diameter, such that rotation of the first cutters 20 corresponds to the rotation of the second cutters 30.

The frame 50 generally includes a pair of lateral support plates 52 (52*a*, 52*b*) spaced apart by one or more horizontal supports 54 (54*a*, 54*b*) so as to accommodate the first and second sets of cutters 20, 30. In one implementation, a pair or rods 54*a*, 54*b* may be used which may be connected to the lateral support plates 52 by suitable fastening means, such as screws 56.

The lateral support plates 52 each include a respective pairs of holes to rotationally support the ends of the shafts of the first and second sets of cutters. Preferably, each of the shafts may be supported by bearings or bushing that may be inserted into the respectively holes to reduce frictional forces. One or both of the lateral support plates 52 may be adapted to support the drive mechanism 40, and/or gear box 42, using suitable fastening means, such as screws 58.

FIGS. 4*a*-4*d* show an exemplary sequence of shredding operation using the dual stage cutting mechanism 10, in accordance with one embodiment of the disclosure. The structural elements of the dual stage cutting mechanism 10 have been removed from the figures for clarity.

Figure 4A:
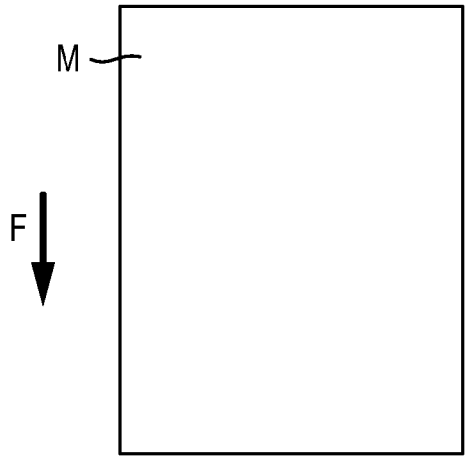
FIGS. 4*a*-4*d* show an exemplary sequence of shredding operations using the dual stage cutting mechanism, in accordance with one embodiment of the disclosure.

Material M, for example, a sheet of paper, may be introduced into a dual stage cutting mechanism 10. FIG. 4*a* shows the material M prior to being introduced into the dual stage cutting mechanism 10 in a fed direction F.

Figure 4B:
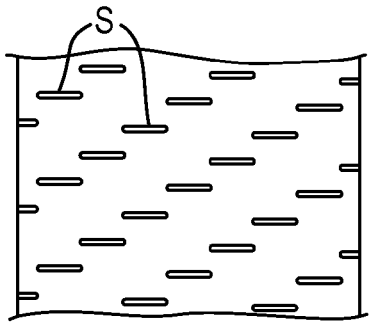

FIG. 4*b* shows a portion of the materials M as it passes through the first cutters. As can be seen, the first cutters will pierce rows of staggered cross-cuts (slots) S in the paper forming a "waffle" like pattern. In one implementation (shown), the pierced cross-cuts S may be oriented generally perpendicular to the feed direction F.

Figure 4C:
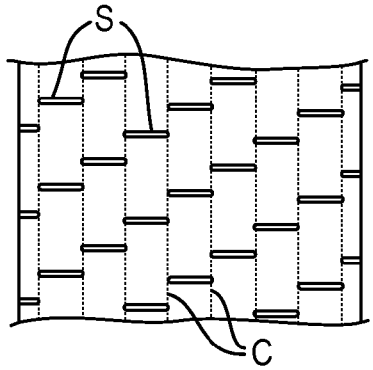

FIG. 4*c* shows a portion of the material M as it passes continues through the second cutters. The second cutters cut a plurality of strip cuts C in the pierced material, which may be oriented parallel to the feed direction F. For clarity, the strip-cuts C have been shown as dotted-lines. Preferably, the first cutting discs and the second cutting discs are positioned such that the staggered cross-cuts are aligned with the strip cuts. As such, debris particles are separated from the material M.

Figure 4D:
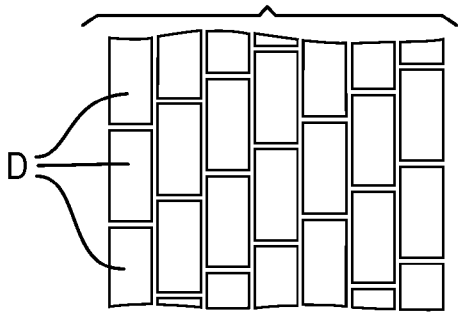

FIG. 4*d* shows some of the debris particles D formed from the shredded material M after having been passed through the first 20 and second cutters 30 of the dual stage cutting mechanism 10. In one implementation, the debris particles D may each have a generally rectangular shape, formed by pierced cross-cuts at its top and bottom and strip cuts from it sides. The debris particles D may drop into a bin or other receptacle for later disposal or recycling.

EXAMPLE

According to one embodiment, the length of the first and second shafts may be 350 mm. The main body of the first cutting discs may have a diameter of 35.8 mm and a width of 5.7 mm. The main body of the second cutting discs may have a diameter of 44.1 mm and a width of 5.7 mm.

The projecting teeth of the first cutting discs may have a length of 5.0 mm. The serrated teeth of the second cutting discs have a length of 0.37 mm. With this configuration, the debris particles formed may be approximately 5.8 mm×17 mm.

The various components of the dual stage cutting mechanism 10 may be formed of suitable materials, as will be appreciate by those skilled in the art. For example, cutting members may be formed from suitable materials (e.g., steel) which may be tempered to otherwise heat-treated to provided hard and durable cutting edges Structural materials, such as the frame, may be formed of rigid materials, such as metals (e.g., steel or aluminum) or engineering plastics.

The dual stage cutting mechanism 10 may provide various advantages over conventional shredder arrangements. For example, the dual stage cutting mechanism may 10 optimize the cutting capacity by leveraging strip cutting of the second cutters. In addition, the arrangement eliminate the need for a fixed cutting block (found in conventional shredders). As such, the space which would have been ordinarily required for the fixed cutting block may be substantially reduced, for example, up to 50%.

Also, since the material is pierced by the first cutters prior to the entering the second cutters, the material may be strip cut more efficiently because the material does not need to be forced as deep into the cutters (as in conventional strip cutting shredder). Further, the arrangement may eliminate the "slip" associated with conventional cutter arrangements that led to "birdnesting." As such, faster shredding speeds may be realized, and shredding larger and thicker articles such as, compact disks may be made quieter and cause less shattering of the media.

The debris particle length may also be easily adjusted by easily changing the configuration of the first cutters. For example, the spacing of the projecting teeth of the first cutters may control the debris particle length.

While this disclosure has been described in connection with what is presently considered to be the most practical and preferred embodiment, it is to be understood that it is capable of further modifications and is not to be limited to the disclosed embodiment, and this application is intended to cover any variations, uses, equivalent arrangements or adaptations of the inventive concept following, in general, the principles of the disclosure and including such departures from the present disclosure as come within known or customary practice in the art to which the disclosure pertains, and as may be applied to the essential features hereinbefore set forth and followed in the spirit and scope of the appended claims.

What is claimed is:

1. A shredder comprising:

a pair of cooperating first cutters configured to pierce rows of staggered cross-cuts into a material to be shredded, each of the pair of first cutters comprising:

a plurality of first cutting discs equally spaced on a first shaft, wherein each of the first cutting discs includes a main body with a plurality of projecting teeth, and wherein the main bodies of the pair of first cutters are not interleaved with one another; and a pair of cooperating second cutters, disposed down-stream of the pair of first cutters in the material feed direction, that are configured to form a plurality of strip cuts in the pierced material, each of the pair of second cutters comprising:

a plurality of second cutting discs equally spaced on a second shaft, wherein the pair of cooperating first cutters and the pair of cooperating second cutters are provided in parallel configuration with respect to each other and wherein the first cutting discs and the second cutting discs are positioned adjacent to each other such that the staggered cross-cuts formed by the first cutters are substantially aligned with the strip cuts formed by the second cutters.

2. The shredder according to claim 1, wherein the pair of first cutters are interleaved with the of second cutters.

3. The shredder according to claim 1, wherein each of the second cutting discs includes a plurality of serrated teeth.

4. The shredder according to claim 1, further comprising:

a drive mechanism for rotating one or both of the pair of first cutters and the pair of the second cutters.

5. The shredder according to claim 1, wherein the teeth of the first cutters taper to a cutting edge.

6. The shredder according to claim 5, wherein the cutting edges curve slightly inwardly.

7. The shredder according to claim 1, wherein the first cutting discs are staggered on their respective first shafts, such that the teeth of one of the pair of first cutters extend within spaces between adjacent teeth of the other of the pair of the first cutter.

8. The shredder according to claim 1, wherein the second cutting discs are staggered on their respective second shafts, such that the second cutting discs of one of the pair of second cutters extend within spaces between adjacent discs of the other of the pair of the second cutters.

9. The shredder according to claim 1, wherein the projecting teeth of the first cutters and the serrated teeth of the second cutters extend with spaces therebetween.

10. The shredder according to claim 1, wherein the first and second cutters are driven together by a drive mechanism.

11. The shredder according to claim 1, wherein pair of first cutters are driven together by a drive mechanism.

12. The shredder according to claim 1, wherein pair of second cutters are driven together by a drive mechanism.

13. The shredder according to claim 1, further comprising a receptacle for receiving debris particles.

14. The shredder according to claim 1, wherein the rows of staggered cross-cuts comprise a waffle pattern.

15. The shredder according to claim 1, further comprising a frame including a pair of lateral support plates and at least one horizontal support there between, the lateral support plates spaced apart so as to accommodate the first and second cutters.

16. A method of shredding material comprising:

feeding material to be shredded;

rotationally driving a pair of cooperating first cutters and a pair of cooperating second cutters, the pair of second cutters disposed down-stream of the pair of first cutters in the material feed direction and provided in a parallel configuration with respect to first cutters;

piercing rows of staggered cross-cuts into the material in a first direction using the pair of first cutters; and subsequently forming a plurality of strip cuts in the pierced material in a second direction that is perpendicular to the first direction using the pair of second cutters, wherein that the staggered cross-cuts are aligned with the strip cuts, so as to form a plurality of debris particles.

17. The method according to claim 16 further comprising: receiving the debris particles in a receptacle.

18. The method according to claim 16, wherein the plurality of staggered cross-cuts comprise a waffle pattern.

19. The method according to claim 16, wherein the pairs of first and second cutters are rotationally driven together using a drive mechanism.

* * * * *